US010077182B2

(12) United States Patent
Leonhardt

(10) Patent No.: US 10,077,182 B2
(45) Date of Patent: Sep. 18, 2018

(54) FUEL CAN ADAPTER

(71) Applicant: MERCEDES TEXTILES LTD., St. Laurent (CA)

(72) Inventor: Duane Leonhardt, Dollard Des Ormeaux (CA)

(73) Assignee: Mercedes Textiles Ltd., St. Laurent, Quebec (CA)

( * ) Notice: Subject to any disclaimer, the term of this patent is extended or adjusted under 35 U.S.C. 154(b) by 61 days.

(21) Appl. No.: 15/299,847

(22) Filed: Oct. 21, 2016

(65) Prior Publication Data

US 2017/0036903 A1 Feb. 9, 2017

Related U.S. Application Data

(63) Continuation of application No. 14/298,054, filed on Jun. 6, 2014, now Pat. No. 9,505,602.

(60) Provisional application No. 61/846,339, filed on Jul. 15, 2013.

(51) Int. Cl.

| | |
|---|---|
| ***B67D 7/04*** | (2010.01) |
| ***B67D 7/00*** | (2010.01) |
| ***B67D 7/78*** | (2010.01) |

(52) U.S. Cl.

CPC ..... *B67D 7/007* (2013.01); *B67D 7/04* (2013.01); *B67D 7/78* (2013.01)

(58) Field of Classification Search

CPC ..... B67D 7/007; B67D 7/04; B67D 7/06
USPC ..... 141/383–384, 387, 391; 220/260, 284, 220/288

See application file for complete search history.

(56) References Cited

U.S. PATENT DOCUMENTS

| | | | | |
|---|---|---|---|---|
| 2,866,473 | A * | 12/1958 | Schutter | B67D 7/42 137/560 |
| 5,154,213 | A | 10/1992 | Malamas et al. | |
| 5,829,494 | A | 11/1998 | Chiu | |
| 6,006,961 | A | 12/1999 | Wark | |
| 6,045,012 | A | 4/2000 | Hansen | |
| 6,142,345 | A | 11/2000 | Laible | |
| 6,363,979 | B1 | 4/2002 | Chafin et al. | |
| 6,543,654 | B1 | 4/2003 | Uhl et al. | |
| 6,669,062 | B1 | 12/2003 | Laible | |
| 7,025,082 | B1 | 4/2006 | Wood | |
| D567,084 | S | 4/2008 | Batton et al. | |
| 8,220,748 | B2 * | 7/2012 | Fenton | B64C 27/20 141/110 |
| D724,699 | S * | 3/2015 | Wyne | D23/259 |
| D739,493 | S * | 9/2015 | Wyne | D23/200 |

(Continued)

FOREIGN PATENT DOCUMENTS

| | | |
|---|---|---|
| CA | 2268407 | 10/2000 |

*Primary Examiner* — Nicolas A Arnett

(74) *Attorney, Agent, or Firm* — Ware, Fressola, Maguire & Barber LLP

(57) ABSTRACT

A fuel can adapter is designed to be used with a fuel can having a neck that is internally and externally threaded. The fuel can adapter includes a plate having external threads for engaging internal threads of the neck, the plate including a hole. The adapter includes a sliding tube mounted to slide within the hole in the plate. The adapter includes an elbow mounted at an upper end of the tube, the elbow including an outlet. The adapter further includes a protrusion extending from the plate beside the hole. The elbow bears against the protrusion to exert a torque on the plate that threads or unthreads the plate from the neck of the fuel can.

12 Claims, 3 Drawing Sheets

(56) References Cited

U.S. PATENT DOCUMENTS

| | | | | |
|---|---|---|---|---|
| 9,505,602 | B2 * | 11/2016 | Leonhardt | B67D 7/007 |
| 2010/0127131 | A1 * | 5/2010 | Fenton | B64C 27/20<br>244/23 A |
| 2013/0199661 | A1 | 8/2013 | McAvey et al. | |
| 2015/0013824 | A1 * | 1/2015 | Leonhardt | B67D 7/007<br>141/1 |
| 2017/0043750 | A1 * | 2/2017 | Liao | F02M 37/22 |

* cited by examiner

FUEL CAN ADAPTER

CROSS-REFERENCE TO RELATED APPLICATIONS

This application is a continuation of U.S. patent application Ser. No. 14/298,054 filed on Jun. 6, 2014, which claims the benefit of U.S. Provisional Patent Application 61/846,339 filed Jul. 15, 2013.

TECHNICAL FIELD

The present invention relates to portable fuel tanks or fuel cans and, more particularly, to adapters for fuel tanks or fuel cans.

BACKGROUND

Portable fuel tanks or fuel cans are used to contain and transport fuel. These portable fuel tanks or cans have a pouring neck for pouring fuel from the can or for pouring fuel into the can. A fuel can adapter may be connected to the neck to enable connection of a fuel-carrying tube or hose directly to a fuel intake line of an internal combustion engine such as an outboard engine, generator, pump or any other such equipment. This permits fuel to be siphoned or drawn from the fuel can. An example of a fuel supply adapter is disclosed in Canadian Patent 2,268,407. This adapter has a U-shaped cross-section defining a hollow top portion into which a connector may be disposed so as to not interfere with a cap. Radial gripping pins are provided inside the bore to handle the adapter.

It would be desirable to improve the design of the fuel supply adapter by providing a more ergonomic design that makes it easier to attach and detach the adapter to a fuel can while also improving the fuel flow to an intake fuel line to which the adapter is connected.

SUMMARY

The present invention provides, in general, a fuel can adapter having a plate that can be detachably connected to a neck of a fuel can by threads. The fuel can adapter has a sliding tube with an elbow that can slide in and out of the plate between an extended fuelling position and a stowed transport position. The elbow, when stowed, abuts and bears against a protrusion on the plate that enables a torque to be applied to the plate by rotating the elbow against the protrusion.

One inventive aspect of the present invention is a fuel can adapter for use with a fuel can having a neck that is internally and externally threaded. The fuel can adapter has a plate having external threads for engaging internal threads of the neck, the plate including a hole. The adapter has a sliding tube mounted to slide within the hole in the plate. The adapter includes an elbow mounted at an upper end of the tube, the elbow including an outlet. The adapter further includes a protrusion extending from the plate beside the hole. The elbow bears against the protrusion to exert a torque on the plate that threads or unthreads the plate from the neck of the fuel can.

Another inventive aspect of the present invention is a fuel can and adapter system that includes a fuel can and a fuel can adapter. The system includes a fuel can that defines a container for containing fuel and a neck having internal threads and external threads. The system also comprises the fuel can adapter that includes a plate having external threads for engaging internal threads of the neck, the plate including a hole. The adapter of the system includes a sliding tube mounted to slide within the hole in the plate and an elbow mounted at an upper end of the tube, the elbow including an outlet. The adapter of the system further includes a protrusion extending from the plate beside the hole, wherein the elbow bears against the protrusion to exert a torque on the plate that threads or unthreads the plate from the neck of the fuel can.

Yet another inventive aspect of the present invention is a method of using an adapter for a fuel can defining a container for containing fuel and a neck having internal threads and external threads. The method entails steps of threading the adapter into the neck of the fuel can by (i) sliding a sliding tube through a hole in a plate of the adapter into the container of the fuel can until an elbow connected to the sliding tube abuts a protrusion mounted to a plate of the adapter and disposed beside the—center hole and (ii) exerting a torque on the elbow to cause the elbow to bear against the protrusion to thereby cause the plate to thread or unthread. The method further entails steps of extending the sliding tube through the in the plate and connecting an outlet disposed on the elbow to a fuel line.

DETAILED DESCRIPTION

Figure 1:
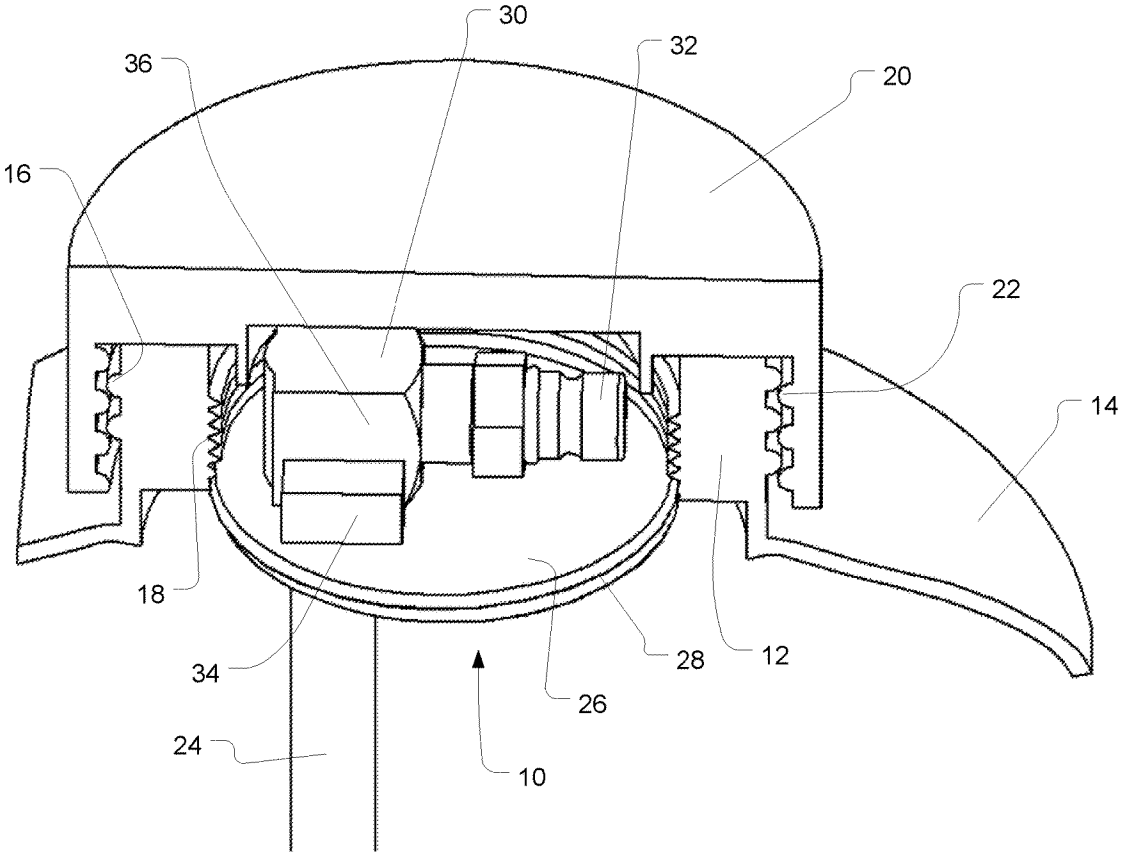
FIG. 1 is an isometric cutaway view of a fuel can adapter in accordance with an embodiment of the present invention.

FIG. 1 is an isometric cutaway view of a fuel can adapter 10 in accordance with an embodiment of the present invention. The fuel can adapter 10 is threaded into a neck 12 of a fuel can 14 (or fuel tank or fuel supply). The fuel may be gasoline (petrol), diesel, or any other liquid combustible substance used as a fuel. The neck is threaded both externally and internally as shown in FIG. 1. In other words, the neck 12 has external threads 16 and internal threads 18. The external threads 16 receive a fuel cap 20. The fuel cap 20 has internal threads 22 which thread onto the complementary external threads 16 of the neck 12 of the fuel can. The cap is screwed onto the fuel can for storage and transport. The cap may be unscrewed to insert or remove the fuel can adapter 10 or to access or utilize the fuel can adapter, e.g. to pour fuel into or out of the can or to connect the adapter to a fuel intake line of an engine.

As depicted by way of example in FIG. 1, the fuel can adapter 10 includes a slidable tube 24 extending downwardly into the bottom portion of the fuel can (e.g. to the bottom interior surface of the fuel can) for extracting fuel from the can. The tube may be rigid or flexible and it may be made of a polymer or other suitable material. The fuel can adapter 10 also includes a generally circular plate 26 with external threads 28 for threading onto the complementary internal threads 18 of the neck.

As further depicted by way of example in FIG. 1, the fuel can adapter 10 includes an elbow 30 and a quick-connect outlet 32 with an internal valve (not shown) disposed within the outlet to selectively control the outflow of liquid. The elbow 30 provides a substantially orthogonal bend (or curved conduit) to permit fuel to flow up the tube and out the outlet 32. In the illustrated embodiment, the outlet 32 is substantially orthogonal to the plate 26 although in other embodiments it may have a different angle, i.e. it need not be orthogonal. In the illustrated embodiment of FIG. 1, the elbow 30 is mounted through a hole in the plate which is off-center relative to a geometrical center (or centroid) of the plate although the hole may be on-center in other embodiments. The off-center hole shown by way of example in FIG. 1 provides an eccentric load point to exert a torque on the plate. The elbow in this illustrated embodiment is therefore also mounted off-center (eccentrically) relative to the plate. Mounted to the plate is a protrusion in the form of a rectangular block 34. The block may be formed integrally with the plate or it may be fastened, welded or otherwise permanently affixed to the plate. A first side face 36 of the elbow abuts and bears against a surface of the block causing the block and plate to rotate if sufficient torque is applied by a user. This permits a user to thread or unthread the plate from the neck simply by manually applying torque to the elbow and block against which the elbow abuts. To turn the plate one way requires the elbow to abut one surface of the block whereas to turn the plate the opposite direction requires the elbow to abut a different surface of the block. In other words, a first face of the elbow bears against one side of the block when turning clockwise and bears against a second side of the block when turning counter-clockwise. In another embodiment, the hole may be on center as opposed to off-center provided that the threaded fitting or quick-connect fitting is compact enough to fit inside the neck after assembly.

In an alternative embodiment, the protrusion from the plate may be a pair of pins (or other rigidly mounted structures) on either side of the hole in the plate such that the plate may be threaded or unthreaded by turning the elbow one way or the other to cause the elbow to bear against one pin or the other. Therefore, the elbow not only serves as a bent fluid conduit but it also acts as a lever to exert torque on the plate.

Figure 2:
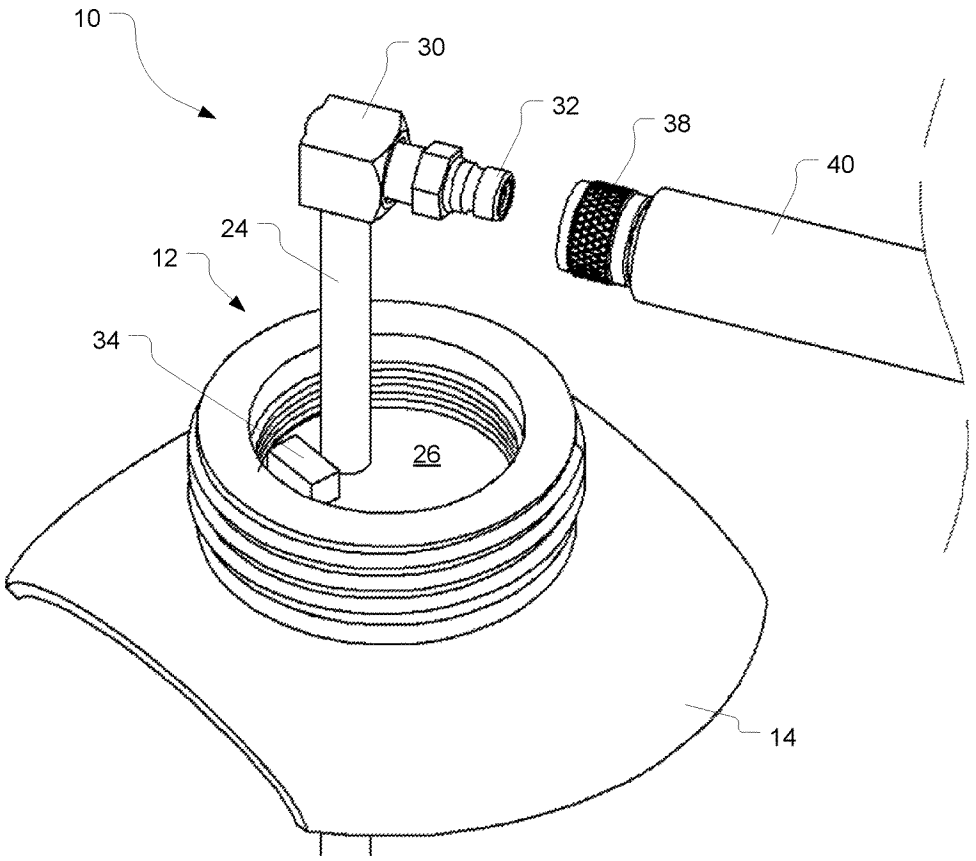
FIG. 2 is an isometric view of the fuel can adapter extended upwardly into a working position.

FIG. 2 is an isometric view of the fuel can adapter 10 extended upwardly into a working (fuelling) position. The slidable tube 24 is pulled upwardly by the user. The slidable tube slides upwardly through the hole in the plate 26. The hole in the plate and the slidable tube may be dimensioned with suitable tolerances to provide a sliding fit or other appropriate fit that enables the tube to slide within the hole. The quick-connect outlet 32 may be a male quick-connect outlet as shown in FIG. 2. This male quick-connect may be connected to a female quick-connect socket 38 which connects to the fuel intake line 40 or fuel conduit of a fuel-combusting engine or other such machine. In the fuelling position, the elbow is spaced above the protrusion (block) 34 and thus cannot, in that position, exert any torque on the block and plate. Only when the elbow is lowered against, or in close proximity to, the plate can the elbow abut and bear against the block. In another embodiment, the quick-connect outlet may be replaced with a threaded connection. In such an embodiment the sliding tube makes it easier to install a threaded connection (threaded fitting) since this may be done outside the confinement of the fuel tank neck. For example, a fuel line inlet may have a female threaded connector which is threaded onto a male threaded elbow using two tools to tighten the connector and elbow together. The tools may be freely operated outside of the confines of the fuel tank neck, thereby facilitating connection of the male threaded elbow to the female threaded connector of the fuel line inlet.

Figure 3:
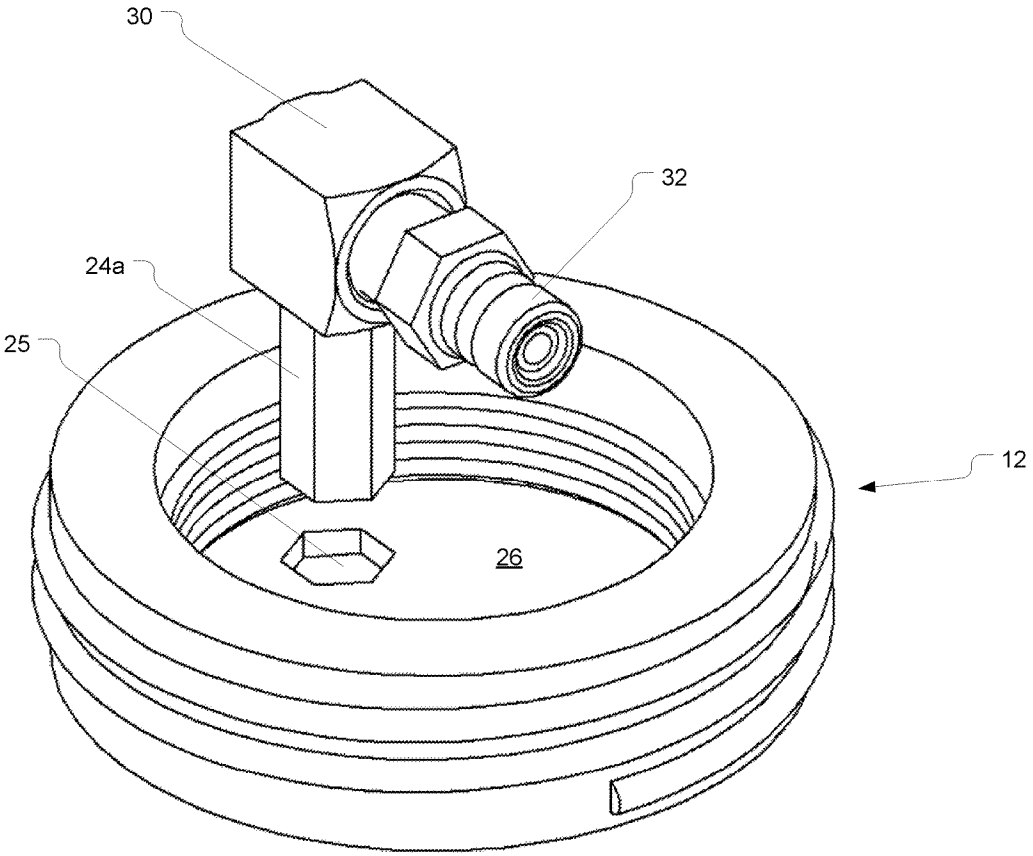
FIG. 3 is another embodiment of the fuel can adapter in which the sliding tube is hexagonal.

FIG. 3 is another embodiment of the fuel can adapter in which the sliding tube is a hexagonal tube 24*a*. At least the upper section of the tube must be rigid to transfer torque to the plate. The hole in the plate is a hexagonal hole 25 in this embodiment. This design eliminates the need for the protrusion (e.g. rectangular block). Turning the elbow causes the rigid hexagonal tube section to rotate the plate. The hexagonal hole is off-center (eccentric) to generate torque on the plate. The hexagonal design is presented to illustrate that other non-circular shapes of holes and tubes (or tube sections) may be used to provide the torque needed to turn the plate. Alternatively, the tube may be provided with a keyway (or rib) that engages a keyway (or slot) in the hole. For example, the tube may have splines to transmit torque to corresponding spline-matching grooves in the plate.

This invention provides numerous advantages over the prior art adapter described in the background.

Firstly, the design is more ergonomic in that it makes it easier for a user to attach or detach the adapter to and from the fuel can. The present design provides more finger space or wrench space inside the neck to turn the adapter than does a prior-art U-shaped design. The design uses the elbow itself to turn the plate, eliminating the need for radial gripping pins.

Secondly, the elimination of the U-shaped body, which is made of metal, reduces the weight of the adapter, making it easier to carry, and reduces the amount of material required to fabricate the adapter, saving cost.

Thirdly, the elbow design simplifies access to most fuel intake lines. In other words, the elbow design enables the user to draw out the fuel connection so that the hose does not need to go straight up and then form a radius or bend back down. With the prior art design, the fuel line is higher in elevation causing more issues with air entrapment, which could cause engines to run lean by restricting the siphon. The elbow design also requires less fuel line to reach the intake fuel line as the return bend radius is about half with the elbow design.

The embodiments of the present invention that are described herein are intended to be exemplary only. Persons of ordinary skill in the art will appreciate that variations, modifications and refinements may be made to the inventive concept(s) presented herein.

What is claimed:

1. A fuel can adapter for use with a fuel can having a neck that is internally and externally threaded, the fuel can adapter comprising:

a plate having external threads for engaging internal threads of the neck, the plate including a hexagonal hole;

a sliding tube mounted to slide within the hexagonal hole in the plate;

an elbow mounted at an upper end of the tube, the elbow including an outlet; and wherein the elbow comprises a rigid hexagonal tube for exerting a torque on the plate via the hexagonal hole to thread or unthread the plate from the neck of the fuel can.

2. The fuel can adapter of claim 1 wherein the hexagonal hole is eccentrically disposed in the plate.

3. The fuel can adapter of claim 1 wherein the external threads receive a fuel cap.

4. The fuel can adapter of claim 1 wherein the outlet is a quick-connect outlet.

5. The fuel can adapter of claim 1 wherein the elbow is an orthogonal elbow.

6. The fuel can adapter of claim 1 wherein the neck defines a bore into which the elbow and outlet fit.

7. A fuel can adapter for use with a fuel can having a neck that is internally and externally threaded, the fuel can adapter comprising:

a plate having external threads for engaging internal threads of the neck, the plate including a non-circular hole;

a sliding tube mounted to slide within the non-circular hole in the plate;

an elbow mounted at an upper end of the tube, the elbow including an outlet; and wherein the elbow comprises a rigid non-circular tube matching the non-circular hole for exerting a torque on the plate via the non-circular hole to thread or unthread the plate from the neck of the fuel can.

8. The fuel can adapter of claim 7 wherein the non-circular hole is eccentrically disposed in the plate.

9. The fuel can adapter of claim 7 wherein the external threads receive a fuel cap.

10. The fuel can adapter of claim 7 wherein the outlet is a quick-connect outlet.

11. The fuel can adapter of claim 7 wherein the elbow is an orthogonal elbow.

12. The fuel can adapter of claim 7 wherein the neck defines a bore into which the elbow and outlet fit.

* * * * *